United States Patent [19]

Reichert

[11] 4,329,974

[45] May 18, 1982

[54] FIREPLACE GRATE LIFT AND LOCK ATTACHMENT

[76] Inventor: Robert B. Reichert, E. 7918 Glass, Spokane, Wash. 99206

[21] Appl. No.: 174,915

[22] Filed: Aug. 4, 1980

[51] Int. Cl.[3] ..... F23H 13/00

[52] U.S. Cl. ..... 126/164; 126/152 B

[58] Field of Search ..... 126/164, 165, 152 B, 126/298, 154, 336; 248/237, 205 R

[56] References Cited

U.S. PATENT DOCUMENTS

| | | | |
|---|---|---|---|
| 1,154,855 | 9/1915 | Gallup | 248/237 |
| 1,917,809 | 7/1933 | Reiman | 248/237 |
| 2,843,109 | 7/1958 | Chapla | 126/165 |
| 3,125,090 | 3/1964 | Wise | 126/164 |
| 3,339,540 | 9/1967 | Kreider | 126/121 |
| 4,161,168 | 7/1979 | Cagle | 126/164 |

*Primary Examiner*—James C. Yeung

*Attorney, Agent, or Firm*—Wells, St. John & Roberts

[57] ABSTRACT

An attachment for mounting a fireplace grate to a fireplace hearth for pivotal movement between a horizontal operative position and an upright inoperative position. Access to the hearth area for cleaning is gained as the grate is pivoted to the inoperative position. A stop mechanism is provided to selectively hold the grate in its inoperative position and is releasable, to allow pivotal motion of the grate downwardly to its operative position.

5 Claims, 5 Drawing Figures

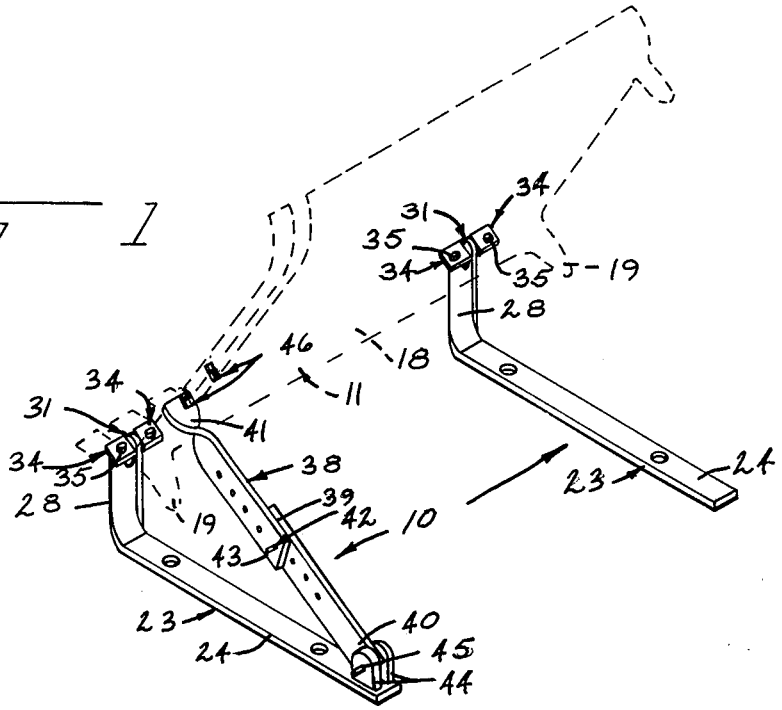
FIG 1
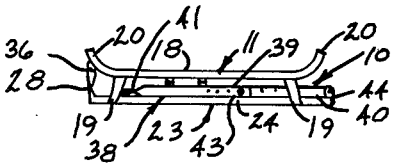
FIG 2
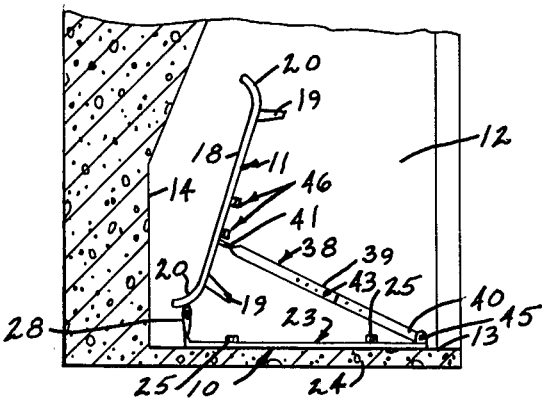
FIG 3
FIG 4
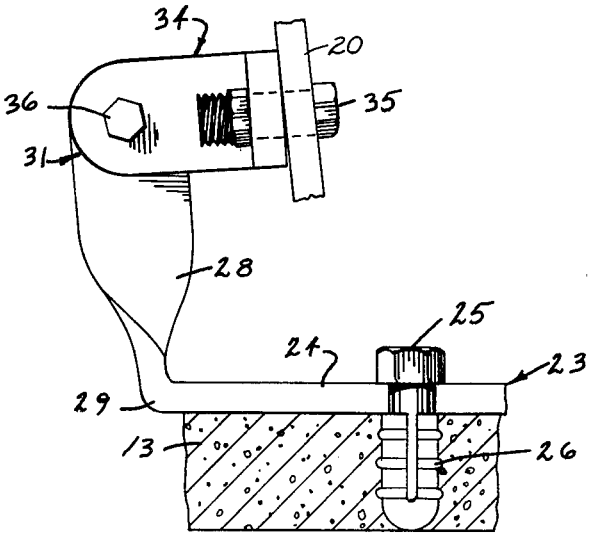
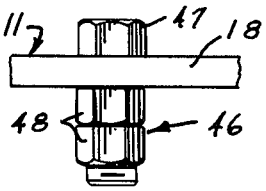
FIG 5

FIREPLACE GRATE LIFT AND LOCK ATTACHMENT

BACKGROUND OF THE INVENTION

The present invention is related to an apparatus adapted to mount a fireplace grate for movement to a position clear of the hearth, thus allowing free access to the hearth for cleaning purposes.

Ash accumulation in the hearth of a fireplace is difficult and messy to remove, especially where a grate obstructs access to the hearth floor. Conventional grates are usually very heavy cast iron devices elevated by upright legs several inches above the hearth surface. The grates themselves become covered with ash, and if removed from the hearth, almost always spread ash and dust over the surrounding area.

It thus becomes desirable to obtain some form of grate that can be left within the fireplace during cleaning, while allowing access to the hearth area overlapped by the grate. Better yet, for convenience and reduction of expense, it is desirable to obtain some form of attachment that is readily adaptable to mount an existing conventional grate to a fireplace hearth for selective movement thereon between the standard horizontal operative position and an elevated inoperative position clear of the hearth.

U.S. Pat. No. 3,339,540 granted on Sept. 5, 1967 to Peter A. Kreider discloses a portable precast fireplace in which a grate is hinged directly to the upright rear wall of the fireplace. The grate can be raised and secured in an upright position for cleaning. However, the mechanism used for securing the grate in an upright position requires that one lift and hold the grate in an upright position and at the same time reach into the fireplace to the rear and upper section of the firebox to secure the grate to a hook mounted thereto. The position that one must take to release the grate from the hook could represent a potential safety hazard should the grate be dropped in the process. Furthermore, the Kreider device is included integrally with a preformed-precast fireplace. The grate, hinge structure, and catch are all produced simultaneously with the remainder of the fireplace. Consideration was not made with regard to adaptability for the hinged structure to conventional forms of self-supporting fireplace grates.

U.S. Pat. No. 3,125,090 granted on Mar. 17, 1964 to G. E. Wise discloses an andiron set that also incorporates a hinge and hook arrangement at the rear of the fireplace for holding a grate or andirons in a raised position for cleaning. The grate supporting arrangement in this apparatus is very similar to that shown by Kreider and discussed above with the exception that the hook catch mechanism is mounted to an adjustable overhead frame member that is braced against the fireplace lintle. Therefore, supposedly, this device is adaptable to fit various size and configuration fireplaces. However, most fireplaces vary in depth, width and vertical openings. The adjustments required, therefore, represent a substantial cost factor in production of the device in addition to increasing complexity for installation.

The Wise andiron set requires that the upright frame (braced at the lintle) be wedged between the lintle and the back wall of the fireplace. This necessarily places the grate or andirons directly adjacent to the backwall of the fireplace opening. Often, this area is not the most desirable area for efficient burning. Fireplaces that are designed properly allow positioning of the burning material closer to the fireplace opening. This allows for more heat radiation and circulation of burning gases before they are drawn into the flue. Fires placed closely adjacent to the back wall of the firebox lose much heat, with the burning gases escaping directly into the flue.

The present invention is embodied in an attachment that can readily mount conventional forms of fireplace grates to any fireplace hearth. Additionally, the present invention can be used safely and conveniently from the front of the fireplace using ordinary fireplace tools. A bracing arrangement is provided that is situated along or adjacent the hearth floor and is easily accessible without requiring the user to reach far into the firebox. The attachment, because it is adaptable to fit many existing forms of standard fireplace grates, can be produced and sold at minimal costs. Furthermore, the apparatus can be attached to a conventional fireplace grate as a factory assembly service or can be purchased separately and attached to existing grates by the homeowner.

BRIEF DESCRIPTION OF THE DRAWINGS

FIG. 1 is a pictorial view of the present attachment with a fireplace grate shown diagrammatically by dotted lines;

FIG. 2 is an end view of the present attachment mounted to a fireplace grate;

FIG. 3 is a view showing the present apparatus holding a grate in an elevated inoperative position within a fireplace firebox;

FIG. 4 is an enlarged detail view of a hinge mechanism for the present invention; and FIG. 5 is an enlarged detail view of an abutment device mounted to the grate.

DETAILED DESCRIPTION OF A PREFERRED EMBODIMENT

The present attachment is shown generally in the drawings by the reference number 10. The present attachment 10 is provided for mounting a conventional fireplace grate 11 within a fireplace along the hearth 13 thereof. FIG. 3 shows a preferred arrangement of the present attachment 10 and grate 11 within a fireplace. The attachment is shown spaced forwardly from the back wall 14 within the firebox 12.

The present attachment 10 is adapted to mount nearly any conventional form of self-supported grate 11 that includes a substantially flat grillwork 18 and downwardly depending legs 19. It is preferable, though not for purposes of the present invention, that the grate 11 have upwardly inclined front and back lips 20 to prevent burning material from rolling off the grate and possibly out of the firebox.

Details of the present attachment 10 are shown in FIGS. 1, 4 and 5 while operation of the present attachment is illustrated by FIGS. 2 and 3. FIGS. 1 and 4 show the present attachment including one and preferably two, elongated support brackets 23. Each bracket 23 includes a horizontal elongated hearth mounting member 24. This member is preferably drilled to receive the shanks of lag bolts 25 secured within bolt shields 26 that are anchored to the firebrick of the hearth within appropriately drilled holes. It is noted, although this is a preferred method of attachment for the support brackets to the fireplace hearth, other methods or means of attachment may be used. For example, forms of fire resistant adhesive or mortar compound could conceivably be used to secure the brackets to the hearth surface.

At inward ends of the hearth mounting members 24 are upstanding members 28. Members 28 are preferably formed integrally with the hearth mounting members 24. The upright members 28 extend from bends 29 (FIG. 4) at their intersections with the hearth mounting members 24 to upper ends that are slightly lower in elevation than the upper edges of the grate lips 20. The members 28 are also twisted along their lengths so the flat surfaces thereof are oriented at substantially perpendicular angles to the similar surfaces on the hearth mounting members.

Upper ends of the upstanding members 28 represent first hinge members 31. Second hinge members 34 are provided and are adapted to be mounted to a typical fireplace grate 11 and pivotably attached to the first hinged members by pivot pins or bolts 36. The second hinge members 34 may be secured to the grate 11 with conventional fasteners 35. However, it is pointed out again, that other various forms of fasteners can be utilized, including clip or clamp arrangements by which the second hinge member would be secured by set screws to the grate. The pins 36 are coaxial, interconnecting the two hinge members of each support bracket to the rearward side of the grate. The hinge axis defines the pivotal motion of the grate from an operative position as shown in FIG. 2 to the inoperative position shown in FIGS. 1 and 3. The grate may be secured selectively in the inoperative position as shown in FIGS. 1 and 3 by provision of a stop means generally shown at 38.

Stop means 38 may include a brace member 39 that is pivoted at an end 40 to one of the support brackets 23. The remaining free end 41 of the brace member swings in an arc about the axis of the pivot from a horizontal inoperative position (FIG. 2) to an upwardly inclined operative position (FIGS. 1 and 3).

The brace member 39 may be provided in two interconnected sections. With this arrangement a length adjusting means 42 can be provided using the brace sections and a series of equally spaced apertures along the length of each section. Length of the rigid brace member can be adjusted by sliding the two sections longitudinally relative to one another until appropriate apertures come into alignment. Nut and bolt fasteners 43 can be used to secure the adjusted member sections together.

The pivoted end 40 of brace member 39 is mounted by pivot brackets 44 on one of the support brackets 23. The pivot brackets 43 extend upwardly from an end of the support bracket 23 opposite the associated upstanding member 28. A pin 45 or bolt extends through the pivot brackets 43 and end 40 to define a pivot axis for the brace member 39 that is parallel to the grate pivot axis defined by pins 36.

The free end 41 of the pivot brace member 39 is twisted to provide an abutment surface that can be selectively interlocked with an abutment means 46 (FIG. 5) on the grate. The abutment means 46 is mounted to the grate for interlocking with brace member when the grate is in its inoperative, upright position (FIGS. 1 and 3). The abutment means 46 may simply be comprised of one or more stop bolts 47 that extend through drilled apertures formed through the grill work 18, in alignment with the pivotal path of the free brace end 41. The bolts 47 can pass through the apertures and threadably mount nuts 48 along a bottom side thereof.

As an alternative, it is understood that the abutment means 46 could be provided in the form of clips (not shown) set in position on the grate by conventional set screws or other fastening devices.

Mounting of the present attachment to a conventional fireplace grate 11 begins with placing the grate on a flat surface. The support brackets 23 are then positioned beneath the grate with the hearth mounting members 24 resting along the flat surface. The support brackets are positioned so that the upstanding members 28 are located closely adjacent one of the upright lips 20 or longitudinal side, with the hearth mounting members 24 projecting across the width of the grate toward the opposite lip 20 or longitudinal side. The second hinge members 34 can then be held in position on opposite sides of the first hinge members 31 to gauge the position required for the fasteners 35. Preferably, the hinge members are positioned in relation to the grate so that the brackets are in alignment with existing openings in the grate. In this situation, the fasteners can project through the grate openings to the opposite side thereof where complementary clamping members (nuts) can be attached to secure the hinged members to the grate. Otherwise, the position of the hinge member apertures may be marked on the grate and the grate is drilled to receive the fasteners.

When the hinge members 34 have been attached, the pins 36 can be inserted through the aligned apertures of the mating hinge members. Thus, the grate becomes pivotally attached to the support brackets.

Next, the grate and attached support brackets are positioned within the fireplace hearth to determine the areas at which the support brackets are to be secured to the hearth and to determine positioning of the abutment means 46 on the grate. To do this, the support brackets are held in place while the fireplace grate is pivoted upwardly. Positioning of the grate and support bracket selectively within the firebox is selected so the grate can be pivoted upwardly to a position clear of the hearth without contacting the lintle or back wall of the firebox. The grate is held in this position while the brace member 39 is pivoted upwardly until it engages the grate bottom. The point of engagement is marked. The marked area along the grill work is drilled and the abutment means 46 is attached. If clamps or clips (not shown) are used instead of the abutments shown, the mark could be used to indicate proper positioning for the abutment clamp. If necessary length of the brace can also be adjusted at this time to accomodate positioning of the abutment means.

Marks are also made through the mounting apertures in the support brackets for the lag bolts 25. The grate and attachment are then moved aside while appropriate holes are drilled in the firebrick of the hearth. The bolt shields 26 are inserted. Then the grate and attachment are positioned again in the fireplace so the lag bolt receiving apertures are aligned with the bolt shields 26. The lag bolts 25 can then be inserted through the apertures and threaded into the lag shields to secure the support brackets in place and hold them firmly on the hearth against pivotal movement of the heavy grate. This completes installation and assembly of the present apparatus and conventional grate.

It might be noted that several of the above assembly steps may be eliminated if the present apparatus is to be assembled along with a conventional grate by a manufacturer. With this situation, fewer assembly steps are required. First would be positioning of the abutments 46 or, if the abutments are already in position, adjusting the length of the brace member 39 to set the final upright angle of the grate at its inoperative position. The other remaining step would then be to anchor the support brackets on the hearth after properly positioning the grate.

A fireplace grate on the present attachment is used in the usual manner when it is self-supported in the operative position (FIG. 2). For cleanout purposes, however, the grate is shifted up to its inoperative position and held in place by the brace member 39 (FIGS. 1 and 3). This can be accomplished using bare hands, or more preferably, two typical fireplace tools. For example, the grate can be lifted and held at the upright position by, say, a typical fireplace shovel while the brace is lifted and positioned by the poker. The user therefore need not lean into the firebox or come into direct contact with the ash. Once the grate has been lifted to the inoperative position, cleanout of the hearth is made a simple matter by merely shoveling the ash out from below the upright grate into a bucket or down an appropriate ash cleanout, if provided.

When the cleaning job is finished, the same tools can be used to lower the grate to its operative, horizontal position. The grate is pushed back and upwardly toward the rear of the fireplace. This motion allows disengagement of the interlocked abutment and brace member so that the brace member will drop gravitationally to its normal position upwardly adjacent the associated support bracket. The grate can then be pivoted back downwardly until it comes to rest on its legs 19 on the hearth surface.

The above description and attached drawings are given by way of example to set forth a preferred form of the present invention. Other forms and modifications may be envisioned which fall within the scope of my invention as set forth in the following claims.

What I claim is:

1. An attachment mountable to a fireplace grate having a grillwork and integral fixed downwardly depending legs for mounting the grate to a fireplace hearth for pivotal movement between a horizontal operative position and an upright inoperative position wherein the grillwork and legs are clear of the hearth, comprising:

an elongated hearth mounting member adapted to fit flush against the hearth;

an upstanding member on the elongated hearth mounting member adapted to project upwardly from the hearth;

a first hinge member on said upstanding member;

a second hinge member adapted to be mounted to the grillwork of the fireplace grate;

hinge pin means for pivotably connecting the first and second hinge members and defining a grate pivot axis;

a brace member; and brace pivot means mounting the brace member to the hearth mounting member for pivotal movement thereon between a horizontal normal position resting against the hearth mounting member and an upwardly inclined operative position for bracing the grate in its upright inoperative position.

2. The attachment as claimed by claim 1 wherein the hearth member and the upstanding member are integral and are formed of a metal bar having an angular bend adjacent one end thereof to form said upstanding member.

3. The attachment as defined by claim 1 further comprising:

abutment means adapted to be mounted on the grate for releasably interlocking with said brace member when in its inclined operative position.

4. The attachment as claimed by claim 3 wherein the brace member is elongated, having one end for selectively interlocking with the abutment means and an opposed end pivotably mounted to said elongated hearth mounting member; and wherein said brace member includes length adjusting means for selectively adjusting the length of said brace member between ends thereof.

5. The attachment as claimed by claim 4 wherein said brace member is mounted to said elongated hearth mounting member for pivotal movement thereon about an axis that is parallel to said grate pivot axes and wherein said pivot axes are spaced apart at opposite ends of said support bracket.

* * * * *